US009689075B2

(12) United States Patent
Gomez et al.

(10) Patent No.: US 9,689,075 B2
(45) Date of Patent: Jun. 27, 2017

(54) CATHODIC PROTECTION DEVICE WITH JOINING MECHANISMS AND ARTICULATED BARS

(71) Applicant: Corrosión y Protección Ingeniería S.C., Morelos (MX)

(72) Inventors: Lorenzo Martinez Gomez, Morelos (MX); Lorenzo Martínez Martínez de la Escalera, México DF (MX); Jorge Joaquín Cantó Ibáñez, México DF (MX); José Julián Sánchez Hernández, México DF (MX); Alejandro Dávila Martinez, Coahuila (MX)

( * ) Notice: Subject to any disclaimer, the term of this patent is extended or adjusted under 35 U.S.C. 154(b) by 51 days.

(21) Appl. No.: 14/221,671

(22) Filed: Mar. 21, 2014

(65) Prior Publication Data

US 2015/0159281 A1 Jun. 11, 2015

(30) Foreign Application Priority Data

Dec. 9, 2013 (MX) ..... MX/a/2013/015082

(51) Int. Cl.
*C23F 13/00* (2006.01)
*C23F 13/18* (2006.01)

(52) U.S. Cl.
CPC ..... *C23F 13/18* (2013.01); *C23F 2213/31* (2013.01); *Y10T 29/49117* (2015.01)

(58) Field of Classification Search
CPC ..... C23F 13/02; C23F 13/06; C23F 13/08; C23F 13/10; C23F 2213/20; C23F 2213/30–2213/32; C23F 13/16; C23F 13/18
USPC ..... 204/196.01, 196.08, 196.28, 196.3, 204/196.31, 196.33, 196.34, 196.36, 204/196.37; 205/724, 740
See application file for complete search history.

(56) References Cited

U.S. PATENT DOCUMENTS

| | | | | |
|---|---|---|---|---|
| 3,868,313 | A | 2/1975 | Gay | |
| 4,089,767 | A | 5/1978 | Sabins | |
| 4,169,028 | A | 9/1979 | Yokoyama et al. | |
| 4,175,021 | A | 11/1979 | Tatum et al. | |
| 4,504,375 | A | 3/1985 | Griffioen | |
| 4,515,669 | A | 5/1985 | Dimond et al. | |
| 4,700,017 | A * | 10/1987 | Morand | 174/86 |
| 5,305,631 | A | 4/1994 | Whited et al. | |
| 6,193,443 | B1 | 2/2001 | Trudeau et al. | |
| 6,214,203 | B1 | 4/2001 | Horton | |

(Continued)

FOREIGN PATENT DOCUMENTS

WO 03042429 A1 5/2003

OTHER PUBLICATIONS

Encyclodpedia.com (Light Bulb, 1994, http://www.encyclopedia.com/topic/Light_Bulb.aspx).*

*Primary Examiner* — Luan Van
*Assistant Examiner* — Alexander W Keeling
(74) *Attorney, Agent, or Firm* — Steven M. Koehler; Westman, Champlin & Koehler, P.A.

(57) ABSTRACT

Embodiments of a cathodic protection device include an anchor bar operably connected to a metallic structure placed in a marine or aquatic environment, a plurality of articulated bars and a joining mechanism. The plurality of articulated bars are connected to one another in a chain-like manner. The joining mechanism is configured to connect the anchor bar to the plurality of articulated bars.

10 Claims, 6 Drawing Sheets

(56) References Cited

U.S. PATENT DOCUMENTS

| | | | | |
|---|---|---|---|---|
| 6,331,242 | B1 | 12/2001 | Horton | |
| 6,461,082 | B1 | 10/2002 | Smith | |
| 6,744,265 | B2 | 6/2004 | Yunovich et al. | |
| 7,138,038 | B1 * | 11/2006 | Britton | C23F 13/06 204/196.36 |
| 2015/0063910 | A1 * | 3/2015 | Meltsov | F03B 13/1815 405/21 |

* cited by examiner

CATHODIC PROTECTION DEVICE WITH JOINING MECHANISMS AND ARTICULATED BARS

CROSS-REFERENCE TO RELATED APPLICATION

This Application claims priority of Mexican Application No. MX/a/2013/015082, filed Dec. 9, 2013, in Spanish. The content of which is hereby incorporated by reference in its entirety.

BACKGROUND

The discussion below is merely provided for general background information and is not intended to be used as an aid in determining the scope of the claimed subject matter.

For corrosion to occur, there must normally be at least two dissimilar metals, an electrolyte (water with any type of salt dissolved in it, for example), and a path between the dissimilar metals that serves as a conductor. Cathodic protection is a widely-used technology employed to protect and control the corrosion of metallic structures, such as pipelines, wells, piers, buildings, storage tanks, ships, off-shore oil platforms, on-shore oil well casings, and other metal structures that are buried or submerged in corrosive electrolytes. Due to its wide use, cathodic protection has become a requirement and/or best practice for controlling the corrosion of various structural metallic components immersed in soil or water.

Cathodic protection prevents corrosion by converting all of the anodic (active) sites on a metal surface to cathodic (passive) sites by supplying electrical current from an alternate source. An anode discharges electrical current according to Ohm's law, which is I=E/R, where I is current flow, E is the difference in potential between the anode and the cathode, and R is the total circuit resistance. Initially, because the difference in potential between the anode and the cathode is high, current will be high. However, as the difference in potential decreases (due to the effect of the current flow on the cathode and the polarization of the cathode), the current will gradually decrease. Generally, the length of the anode is used to determine how much current the anode can produce, and thus, how much surface area can be protected, and the weight of the anode is used to determine the period of time for which the anode can sustain a proper level of protection.

Cathodic protection can be accomplished using sacrificial anodes or impressed current. In a sacrificial anode system, cathodic protection is achieved first by using an alternate source, such as an easily-corrodible, highly-active metal; then by making the alternate source the cathode of an electrochemical cell—the electrode through which electric current flows out of the polarized electrical device; and lastly by placing the alternate source in contact with a less-active metal that is to be protected. The easily-corrodible metal acts as the anode of the electrochemical cell—the electrode through which positive electric charge flows into the polarized electrical device. Because galvanic anodes sacrifice themselves to protect the metal surface that is desired to be protected, this technique is referred to as a sacrificial cathode system.

For larger structures, sacrificial anode systems are not likely to be used, as the sacrificial anodes cannot economically deliver enough current to provide complete protection. However, impressed current cathodic protection systems can be effective for larger structures because those systems use anodes connected to a direct current power source (a cathodic protection rectifier), and as in sacrificial anode systems, the impressed current systems depend on a supply of high energy electrons to stifle anodic reactions on the metal surface. Further, in the impressed current system, the high energy electrons are supplied by the rectifier, such that low energy electrons picked up at a non-reactive anode bed are given additional energy by the action of the rectifier to be more energetic than the electrons that would be produced in the corrosion reaction.

SUMMARY

This Summary and the Abstract herein are provided to introduce a selection of concepts in a simplified form that are further described below in the Detailed Description. This Summary and the Abstract are not intended to identify key features or essential features of the claimed subject matter, nor are they intended to be used as an aid in determining the scope of the claimed subject matter. The claimed subject matter is not limited to implementations that solve any or all disadvantages noted in the Background.

An aspect of the present invention relates to strengthening the structural integrity of a metallic structure used in sacrificial anode and impressed current cathodic protection systems installed in an aquatic and/or marine environment. Some embodiments of the invention are directed to a cathodic protection device having an anchor bar operably connected to the metallic structure and a plurality of articulated bars operably connected to one another in a chain-like manner and configured to support one another. Some embodiments of the cathodic protection device include a joining mechanism configured to connect the anchor bar to the plurality of articulated bars.

These and various other features will become apparent upon reading the following detailed description and upon reviewing the associated drawings.

BRIEF DESCRIPTION OF THE DRAWINGS

In order to provide a better understanding of aspects of the invention, the following drawings are herein attached.

DETAILED DESCRIPTION OF ILLUSTRATIVE EMBODIMENTS

A problem affecting the performance and integrity of both sacrificial anode and impressed current cathodic protection systems installed in an aquatic and/or marine environment is the collision of floating debris on anodic ground beds, which often causes irreparable damage that can result in partial or total loss of financial investment in those systems. The financial loss resulting from the interruption or intermittence of cathodic protection on a metallic structure desired to be protected and the repair of the protection systems can be considerable. Other deleterious effects caused by the progression of corrosion include accidents, fluid leaks, gas leaks, environmental damages, and undesired physical contact of divers or other persons to the cathodic protection anodes.

Illustrative embodiments of the present disclosure are directed to a cathodic protection device 100 used to maintain the structural integrity of a metallic structure 4, including appurtenances joined thereto and any metallic components thereof, when the metallic structure 4 is immersed in flowing or agitated aquatic and/or marine environments (such as, but not limited to, seas, oceans, rivers, riverbanks, ports or any other facility located in turbulent waters with currents) or when the structure 4 is exposed to floating debris or debris dragged by currents in the aquatic or marine environments (which can be caused by heavy rain, for example) and/or to forces exerted by water currents or waves present in the marine environments. Embodiments of the cathodic protection device 100 can be used in connection with sacrificial anode or impressed current cathodic protection systems. Further, some embodiments of the cathodic protection device 100 are designed to inhibit deterioration, which is usually caused by corrosion, and to prevent damage to the metallic structure 4 or appurtenances joined thereto and any metallic components thereof, which are desired to be protected from corrosion. Some embodiments of the cathodic protection device 100 also provide for a response to hydrodynamics that allows for stability of gravity-driven cathodic protection systems when those systems are exposed to waves and aquatic currents, and/or are impacted by debris.

Figure 1:
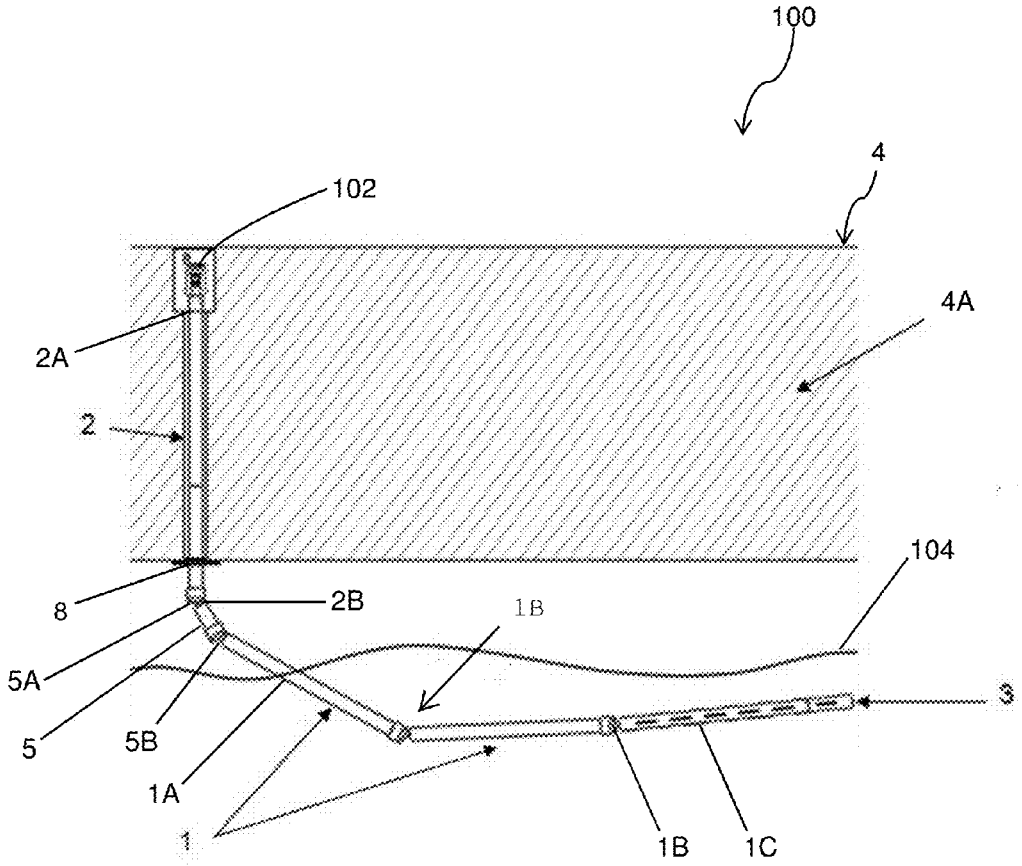
FIG. 1 is a side view of a cathodic protection device according to an embodiment disclosed in the present application.

In accordance with a first exemplary embodiment of the present disclosure, FIG. 1 illustrates a side view of cathodic protection device 100 operably connected to a foundation 4A of a metallic structure 4 that is desired to be protected, which can be a dock, a bridge, a platform, or any other construction built on water. In an exemplary embodiment, device 100 includes a clamping device 102 and an anchor bar 2, where the clamping device 102 is operably connected to a first end 2A of the anchor bar 2 and configured to join the anchor bar 2 to the foundation 4A of the metallic structure 4. By way of example, foundation 4A can be a dock, a bridge, a platform, or any other construction built to float on water.

In some embodiments, anchor bar 2 is secured in place to foundation 4A above water or electrolyte 104. In some embodiments, anchor bar 2 is not submerged in the electrolyte 104. In some embodiments, the anchor bar 2 is arranged to hold in place and support a plurality of articulated bars 1. In an exemplary embodiment, the plurality of articulated bars 1 are removably connected in a chain-like manner (that is, in a series of connected bars that are connected one after the other) by way of a plurality of joining mechanisms 1B. In some embodiments, at least the first articulated bar 1A of the plurality of articulated bars 1 is not submerged, whereas the remaining articulated bars 1 are submerged along with corresponding joining mechanisms 1B. In another exemplary embodiment, at least a portion of the first articulated bar 1A is not submerged, whereas the remaining portion of the first articulated bar 1A and the remaining articulated bars 1, which are connected thereto, are submerged. In yet another exemplary embodiment illustrated in further detail in FIG. 5, at least one of the articulated bars 1 is a submerged articulated bar that is configured to house sacrificed anodes.

As shown in FIG. 1, cathodic protection device 100 includes a joining mechanism 5. Joining mechanism 5 has a first end 5A for operably connecting the joining mechanism 5 to a second end 2B of the anchor bar 2. Joining mechanism 5 further has a second end 5B for operably connecting the joining mechanism 5 to the first articulated bar 1A. In the exemplary embodiment illustrated in FIG. 2, joining mechanism 5 includes a ball joint 5C configured to connect the second end 5B of the joining mechanism 5 to the first articulated bar 1A. Ball joint 5C is configured to provide movement in three degrees of freedom in transnational and rotational directions on X, Y and Z axes, which provides the joining mechanism 5 with the ability to move at a turning angle of approximately 45 degrees (in the illustrative embodiment) in any direction. When each articulated bar 1 is subjected to pressures, impacts, or driving forces caused by aquatic currents or debris dragged by the current such as, for example, logs, algae or any other body submerged in the waters), the flexibility of movements of the joining mechanism 5 has a number of advantages, including minimizing mechanical stresses generated by those conditions and preventing the occurrence of damage on the anodes installed in passageways 3 (discussed later in connection with FIG. 5) of the articulated bars 1.

Figure 2:
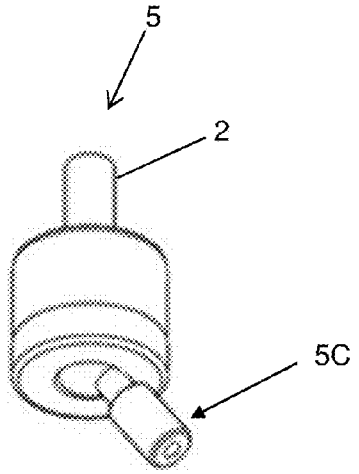
FIG. 2 is a perspective view of a joining mechanism.
Figure 6A:
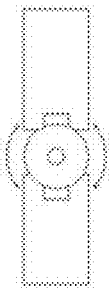
FIG. 6A is a side view of the joining mechanism.
Figure 6B:
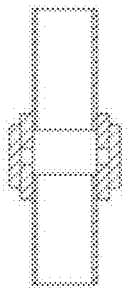
FIG. 6B is a side sectional view of the joining mechanism.
Figure 6C:
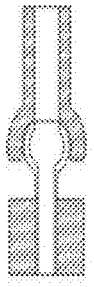
FIG. 6C is a side sectional view of the joining mechanism.
Figure 6D:
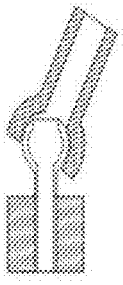
FIG. 6D is a side sectional view of the joining mechanism.
Figure 6E:
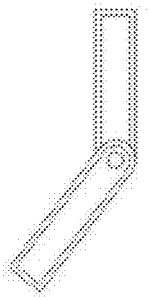
FIG. 6E is a top view of the joining mechanism.
Figure 6F:
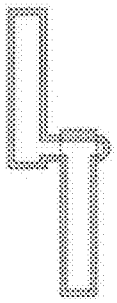
FIG. 6F is a side view of the joining mechanism.

Although illustrated in FIG. 2 as comprising a ball joint 5C, joint mechanism 5 can comprise one or more degrees of rotation. FIGS. 6A, 6B, 6E and 6F illustrate a single pivot connection between two elements forming part of or the complete joining mechanism 5. FIGS. 6C and 6D show another form of a ball joint. Although not shown, universal joints could also be used. As illustrated in FIG. 1, two of such rotational joints can be used. The joining mechanism 5 can also comprise more than two of such joints in any combination.

In an illustrative embodiment, such as the one shown in FIG. 1, the submerged articulated bars 1 have passageways 3 configured to allow passage of cathodic protection current (i.e., electrolyte) into the metallic structure 4 by placing sacrificial anodes inside the submerged portions of the articulated bars 1. In another embodiment, the passageways 3 are configured to allow placing impressed current anodes inside the submerged portions of the articulated bars 1.

Figure 2A:
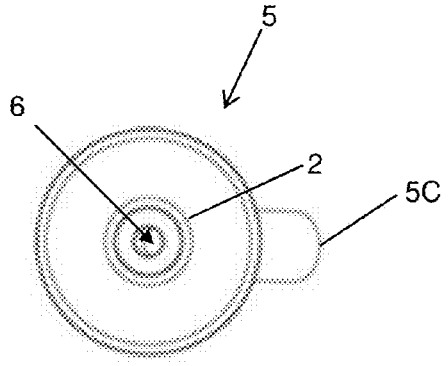
FIG. 2A is a top view of the joining mechanism.
Figure 2B:
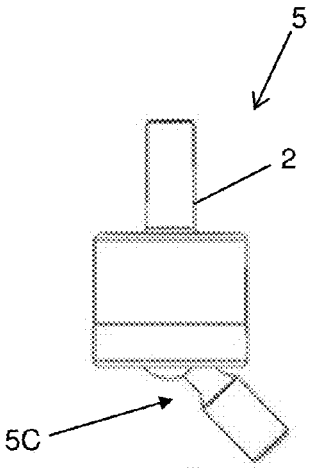
FIG. 2B is a side view of the joining mechanism.
Figure 2C:
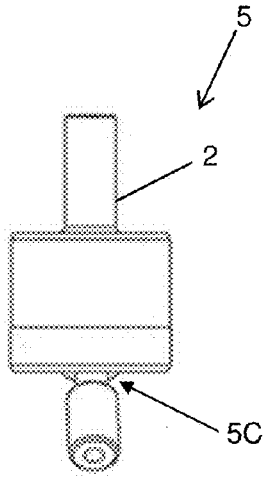
FIG. 2C is a side view of the joining mechanism.
Figure 2D:
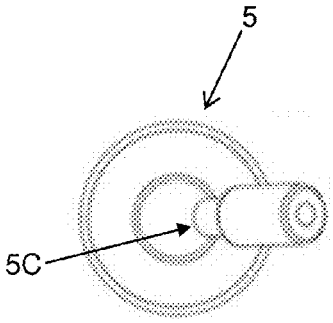
FIG. 2D is a bottom view of the joining mechanism.

As shown in FIG. 2A, joining mechanism 5 can include a coaxial conduit 6 arranged to allow the passing through of cathodic protection anodic wiring. In one embodiment, the coaxial conduit 6 is coated with a material resistant to deformation stresses caused by bending, which in turn is caused by the relative movement of the plurality of articulated bars 1 when formed in the chain-like manner. In an exemplary embodiment, the material used for the assembly of articulated bars and the coaxial conduits can be Nylamid®, a polyamide compound nylon mesh that can be biocompatible.

Figure 3:
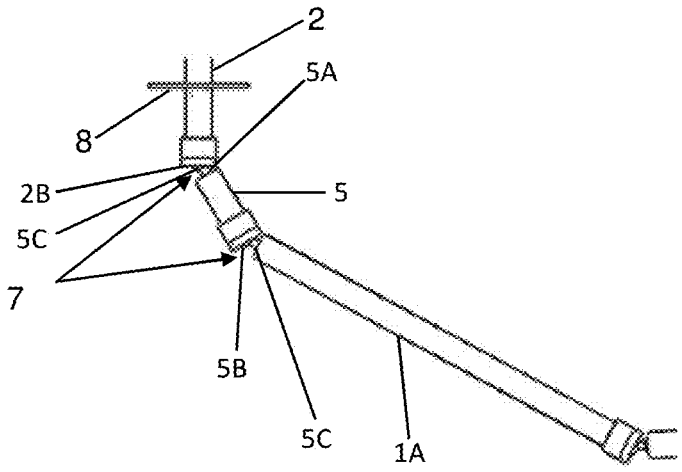
FIG. 3 is a side view of the joining mechanism with double articulation.
Figure 3A:
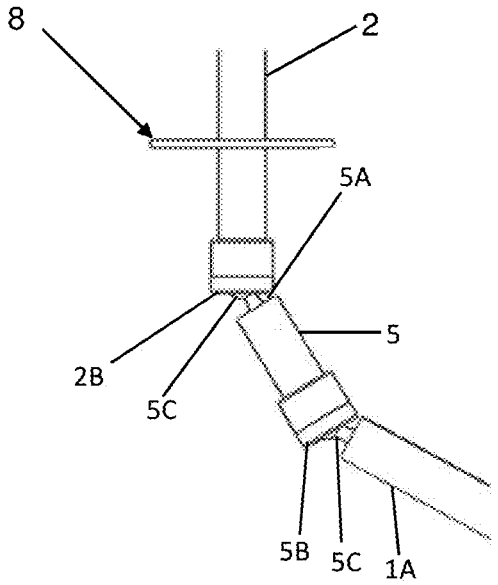
FIG. 3A is a side view of a fixation device.

In the exemplary embodiment illustrated in FIG. 3, cathodic protection device 100 includes a joining mechanism 5 that includes two ball joints 5C arranged to provide for double articulation 7. The first ball joint 5C connects the second end 5B of the joining mechanism 5 to the first articulated bar 1A. The second ball joint 5C connects the first end 5A of the joining mechanism 5 to the second end 2B of the anchor bar 2. Ball joints 5C with double articulation 7 provide joining mechanism 5 with the ability to turn in a solid angle of up to two degrees of freedom. Double articulation 7 of joining mechanism 5 allows for joining mechanism 5 to yield up to 90 degrees in any degree of freedom, thereby reaching a horizontal position in any possible direction that could occur as a result of currents in the water. In one exemplary embodiment illustrated in FIG. 3A, cathodic protection device 100 includes a fixation device 8 configured to keep the joining mechanism 5 in place on the anchor bar 2.

Figure 4:
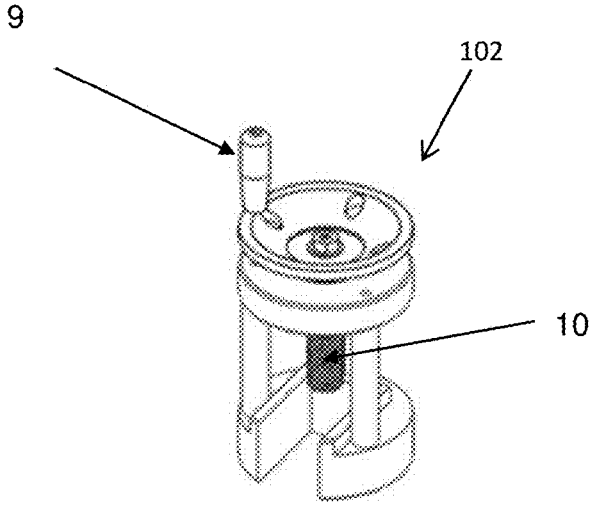
FIG. 4 is a perspective view of a clamping device.
Figure 4A:
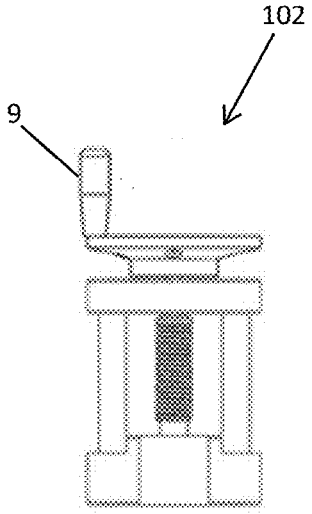
FIG. 4A is a front view of clamping device.
Figure 4B:
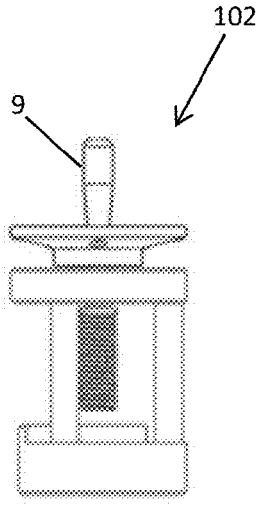
FIG. 4B is a side view of clamping device.
Figure 4C:
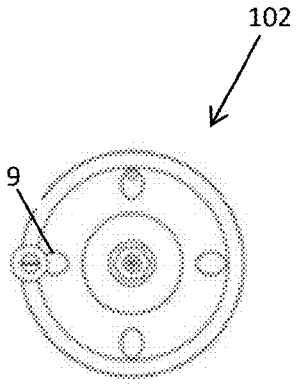
FIG. 4C is a top view of clamping device.
Figure 4D:
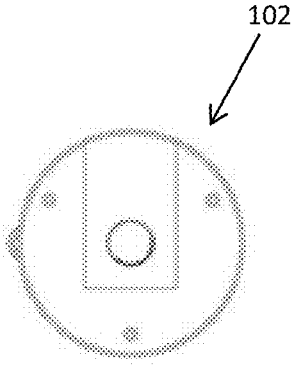
FIG. 4D is a bottom view of clamping device.

FIG. 4 illustrates an exemplary embodiment of the clamping device 102 in further detail. The clamping device 102 is configured to prevent fractures that could be present at or near the first end 2A of anchor bar 2. Clamping device 102 includes a handle 9 (shown in FIGS. 4-4D) that is coupled to an adjustment screw 10 to increase the tightness and prevent unwanted looseness of the coupled connection between the anchor bar 2 and the foundation 4. The clamping device 102 increases tension in the anchor bar 2 when an operator turns handle 9 or a comparable cranking element, which will cause adjustment screw 10 to move so as to allow the adjustment of the anchor bar 2 on the firm foundation 4A.

The dimensions of the articulated bars 1 in the chain-like formation depend on the geometric requirements of the particular cathodic protection design required in order to provide complete protection. In one embodiment, each articulated bar 1 can have variable length, usually between 1 and 3 meters, thereby producing a chain-like formation of articulated bars 1 with a total length that could be from 1 meter to 50 meters or more, as desired, depending on the number of articulated bars 1 used. In the illustrative embodiments, cathodic protection device 100 has two articulated bars 1A, 1 and an articulated housing bar 1C. Articulated housing bar 1C includes grooves or passageways to allow current to flow through the electrolyte to the structure desired to be protected. The housing bar 1C is designed to place the impressed current anodes or the sacrificial anodes in the cathodic protection device 100. However, it will be evident to those skilled in the art that cathodic protection device 100 can be designed with a number of articulated bars 1 that provides complete protection from corrosion of the metallic structure to be protected, which depends on the dimensions of the structure and the demand of cathodic protection current needed.

Figure 5:
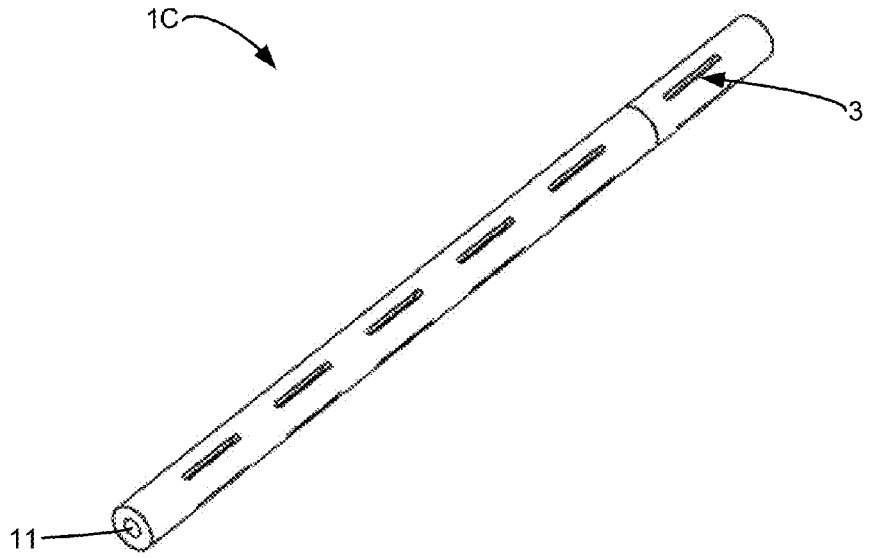
FIG. 5 is a perspective view of a housing bar.
Figure 5A:
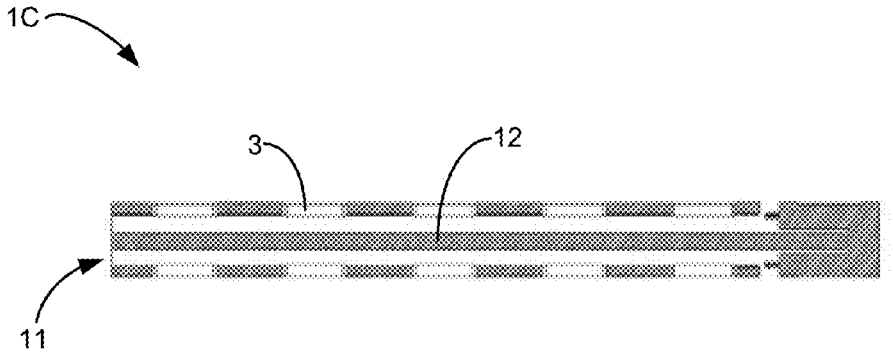
FIG. 5A is a side cross-sectional view of the housing bar of FIG. 5.

FIG. 5 illustrates embodiments of the housing articulated bar 1C in further detail, and FIG. 5A illustrates a cross-sectional view of the housing articulated bar 1C taken generally along a longitudinal axis of the articulated bar 1C shown in FIG. 5. The housing articulated bar 1C is removably joined to the plurality of submerged bars 1 via joining submerged joining mechanism 1B, which can comprise a single or multiple degrees of rotation joining mechanism 5, and includes a plurality of passageways 3 arranged to allow contact of the electrolyte 104 and the cathodic protection current flow with inner surfaces. In some embodiments, the housing articulated bar 1C includes a coaxial perforation aperture 11 configured to set the sacrificed anodes in position. In some embodiments, the aperture 11 is a cavity or a hole of sufficient diameter to allow positioning of the one or more cathodic anodes 12 in place, such as along the central axis of the bar 1C as shown in FIG. 5A. In some embodiments, the coaxial perforation apertures 11 are radial in that they extend along the length and the radius of the housing bar 1C. In some embodiments, the coaxial perforation apertures 11 are spaced no wider than 3 centimeters apart from one another. This spacing prevents direct contact with objects in the electrolyte flowing past the bars 1 that could be subjected to electric discharges associated with the current produced in the cathodic protection device 100. In some embodiments, housing bar 1C can be manufactured from a material that dielectrically isolates the anodes from direct contact with persons or matters outside the housing bar 1C.

It should be noted that parts of the cathodic protection device 100 can be manufactured using a polymer, such as nylon, polyamide or other materials having chemical, mechanical and electrical properties that include, among others, oxidation resistance, durability, shock absorption, dielectric isolation.

Based on the above disclosure, certain embodiments and details have been described in order to illustrate the present invention, and it will be evident for those skilled in the art that variations and modifications may be made without departing from the scope of the present invention.

What is claimed is:

1. A cathodic protection device for a metallic structure, comprising:

an anchor bar configured to be connected to the metallic structure placed in a marine or aquatic environment to electrically conduct a cathodic protection current into the metallic structure;

a clamping device arranged to connect the anchor bar to a foundation of the metallic structure and configured to conduct the cathodic protection current;

at least two articulated bars and an articulated housing bar operably connected to and supporting one another in a chain-like configuration and configured to conduct the cathodic protection current; and a joining mechanism configured to connect the anchor bar to a first of the articulated bars and configured to conduct the cathodic protection current, wherein the joining mechanism comprises a first end connecting to the anchor bar and a second end having a ball joint operably connecting the second end to the first of the articulated bars, and the ball joint is configured to provide movement of the first of the articulated bars in three degrees of freedom relative to the joining mechanism.

2. The cathodic protection device of claim 1, wherein the articulated housing bar includes passageways configured to allow passage of cathodic protection current into the metallic structure.

3. The cathodic protection device of claim 1, wherein the articulated housing bar houses cathodic protection impressed current or sacrificial anodes.

4. The cathodic protection device of claim 1, wherein:

the clamping device is connected near a first end of the anchor bar;

the first end of the joining mechanism is connected to a second end of the anchor bar;

and the first end of the anchor bar and the first of the articulated bars are configured to move in three degrees of freedom relative to each other through the joining mechanism.

5. A cathodic protection device for a metallic structure, comprising:

an anchor bar configured to be connected to the metallic structure placed in a marine or aquatic environment to electrically conduct a cathodic protection current into the metallic structure;

a clamping device arranged to connect the anchor bar to a foundation of the metallic structure and configured to conduct the cathodic protection current;

at least two articulated bars and an articulated housing bar operably connected to and supporting one another in a chain-like configuration and configured to conduct the cathodic protection current; and a joining mechanism configured to connect the anchor bar to a first of the articulated bars and configured to conduct the cathodic protection current, wherein the joining mechanism comprises a first end connecting to the anchor bar and a second end having a ball joint operably connecting the second end to the first of the articulated bars, and wherein the joining mechanism is configured to move at a turning angle of approximately 45 degrees in any direction.

6. The cathodic protection device of claim 5, wherein a portion of a first articulated bar of the articulated bars is not submerged in water.

7. The cathodic protection device of claim 1, wherein the clamping device includes a handle that is coupled to an adjustment screw.

8. The cathodic protection device of claim 5, wherein the articulated housing bar includes passageways configured to allow passage of cathodic protection current into the metallic structure.

9. The cathodic protection device of claim 5, wherein the articulated housing bar houses cathodic protection impressed current or sacrificial anodes.

10. The cathodic protection device of claim 5, wherein the clamping device includes a handle that is coupled to an adjustment screw.

* * * * *